US005390384A

United States Patent [19]

Dinsmoor, III et al.

[11] Patent Number: 5,390,384

[45] Date of Patent: Feb. 21, 1995

[54] SELF-ADJUSTING SEATING SYSTEM

[75] Inventors: John C. Dinsmoor, III, Westminster; Grant C. Denton, Boulder; Richard R. Runkles, Englewood, all of Colo.

[73] Assignee: Jay Medical Ltd., Boulder, Colo.

[21] Appl. No.: 106,420

[22] Filed: Aug. 13, 1993

[51] Int. Cl.[6] ..... A47C 27/18; A47C 7/02

[52] U.S. Cl. ..... 5/654; 297/452.27

[58] Field of Search ..... 5/654, 655, 449, 451, 5/455; 247/DIG. 1, 452.27

[56] References Cited

U.S. PATENT DOCUMENTS

| | | | |
|---|---|---|---|
| 3,237,319 | 3/1966 | Hanson | 36/2.5 |
| 3,798,799 | 3/1974 | Hanson et al. | 36/2.5 |
| 4,038,762 | 8/1977 | Swan, Jr. | 36/89 |
| 4,083,127 | 4/1978 | Hanson | 36/93 |
| 4,108,928 | 8/1978 | Swan, Jr. | 36/71 |
| 4,144,658 | 3/1979 | Swan, Jr. | 36/117 |
| 4,229,546 | 10/1980 | Swan, Jr. | 521/55 |
| 4,243,754 | 1/1981 | Swan, Jr. | 521/55 |
| 4,255,202 | 3/1981 | Swan, Jr. | 102/122 |
| 4,370,769 | 2/1983 | Herzig | 5/452 |
| 4,370,769 | 2/1983 | Herzig et al. | 297/DIG. 3 |
| 4,588,229 | 5/1986 | Jay | 297/459 |
| 4,643,481 | 2/1987 | Saloff | 297/458 |
| 4,660,238 | 4/1987 | Jay | 5/431 |
| 4,726,624 | 2/1988 | Jay | 297/459 |
| 4,728,551 | 3/1988 | Jay | 428/76 |
| 4,753,480 | 6/1988 | Morell | 297/452 |
| 4,761,843 | 8/1988 | Jay | 5/431 |
| 4,842,330 | 6/1989 | Jay | 297/4 |
| 4,952,439 | 8/1990 | Hanson | 428/72 |
| 5,018,790 | 5/1991 | Jay | 297/458 |
| 5,058,291 | 10/1991 | Hanson | 36/117 |
| 5,062,677 | 11/1991 | Jay | 297/444 |
| 5,074,620 | 12/1991 | Jay | 297/444 |
| 5,147,685 | 9/1992 | Hanson | 428/189 |
| 5,189,747 | 3/1993 | Mundy et al. | 5/654 |
| 5,201,780 | 4/1993 | Dinsmoor | 5/455 |

*Primary Examiner*—Alexander Grosz
*Attorney, Agent, or Firm*—W. Scott Carson

[57] ABSTRACT

A seating system primarily intended for use with wheelchairs. The seating system includes a relatively rigid, shaped tray and a fluid pad. The tray has a forward section to support the user's thighs and a rearward section with a depressed, contoured seating well to support the user's buttocks including his ischial tuberosities. The seating well includes a bottom portion and a U-shaped rim portion extending about it. The fluid pad contains a fixed volume of incompressible fluid and is provided and dimensioned to be bunched up and received in the seating well of the tray. The seating system also includes a self-adjusting feature to automatically and properly fit a user based on his weight. This is accomplished in the preferred embodiments by adding a layer of resilient, compressible foam over the upper surface of the rim portion of the seating well between the fluid pad and the rim portion. The foam is dimensioned and chosen to selectively occupy varying amounts of the volume of the seating well (i.e., creating an effective seating well volume) in proportion to the weight of the user. In all embodiments, the resulting seating system automatically modifies the effective seating well volume of the tray in proportion to the user's weight for a safe and proper fit for all users including both light and heavier ones.

57 Claims, 9 Drawing Sheets

Fig. 13
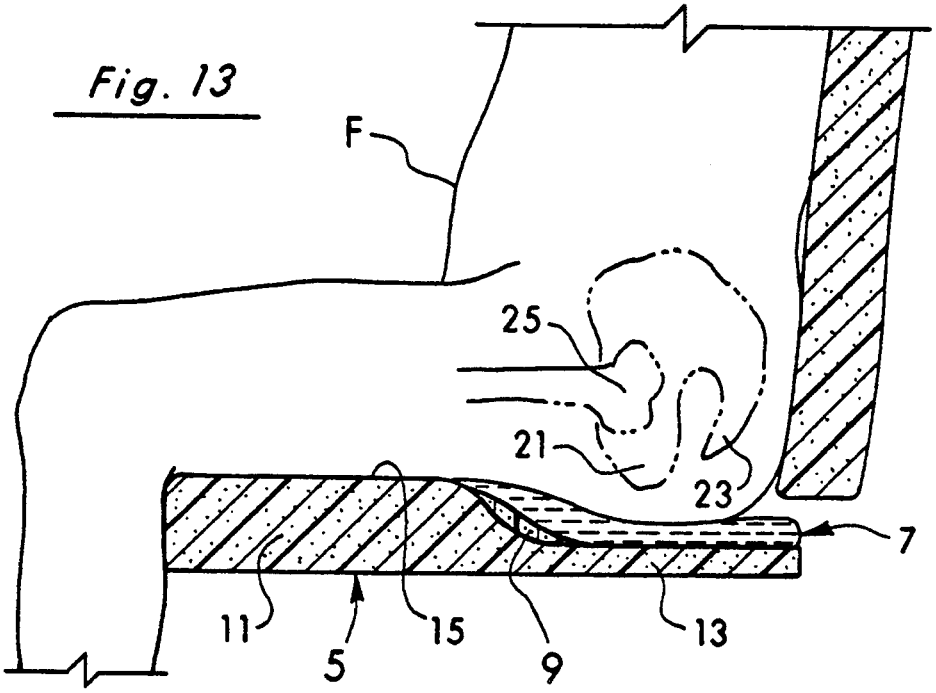
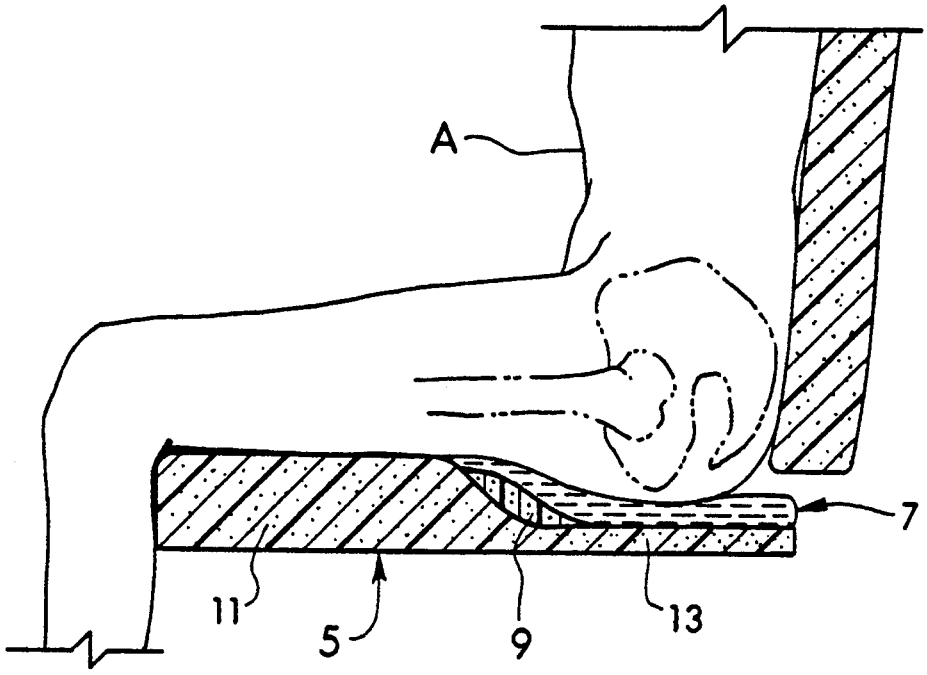
Fig. 14

Fig. 18
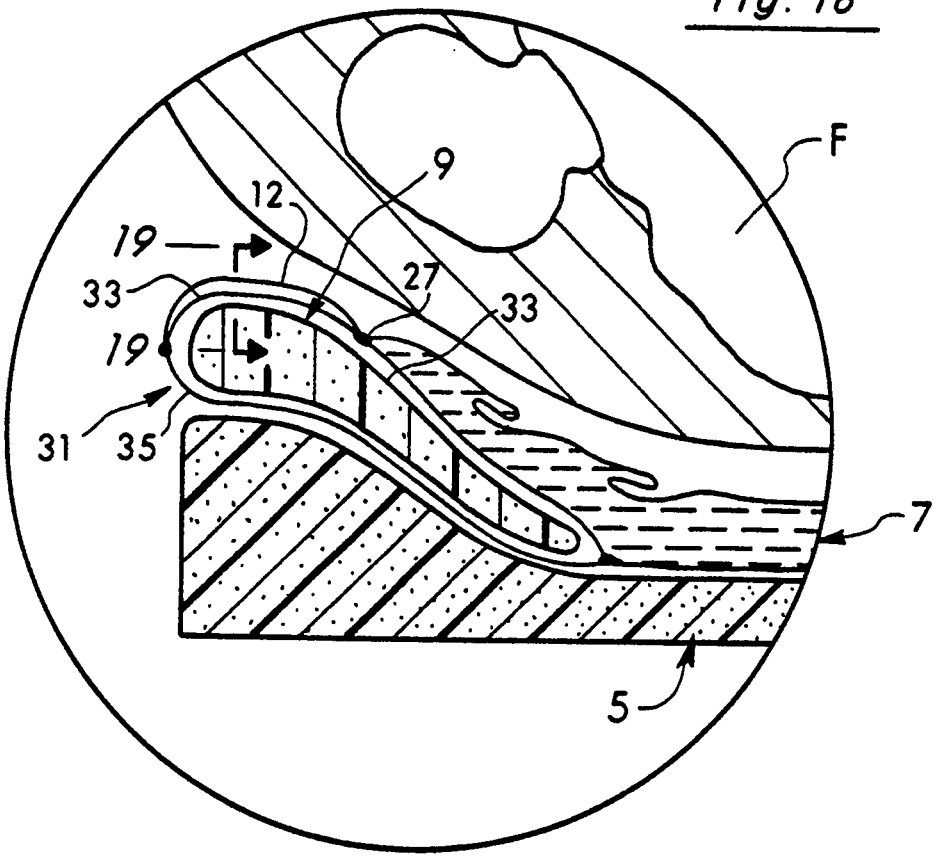
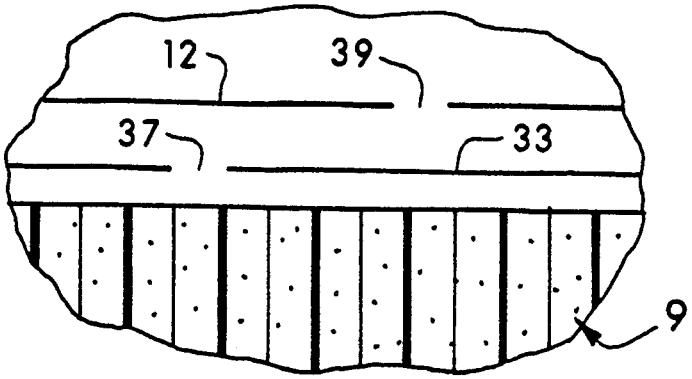
Fig. 19

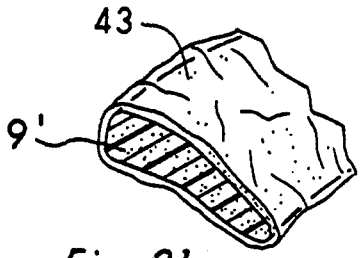
Fig. 21
Fig. 20
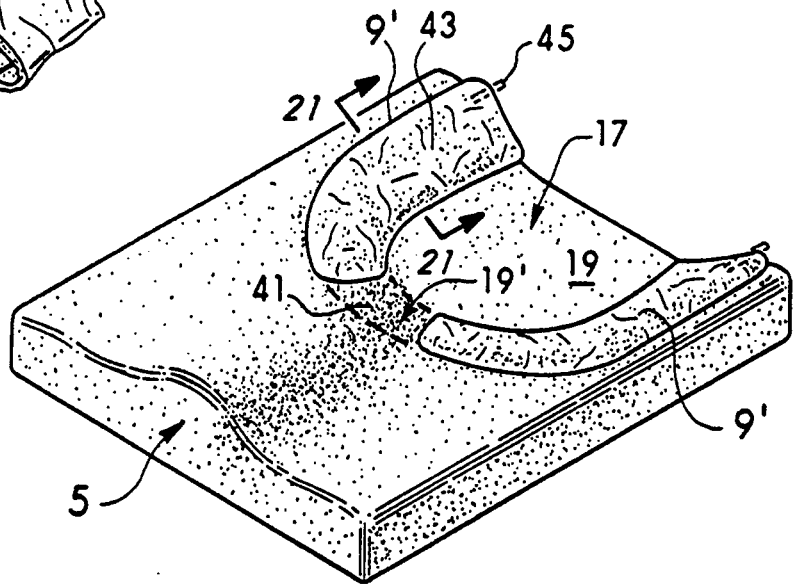
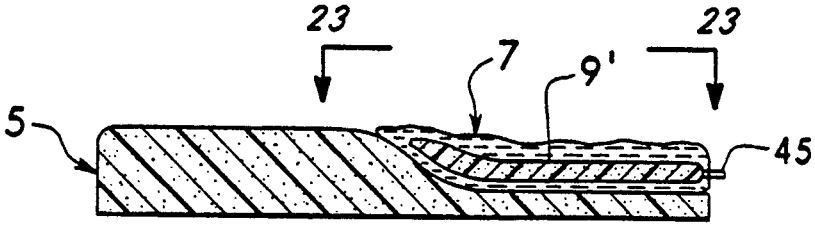
Fig. 22
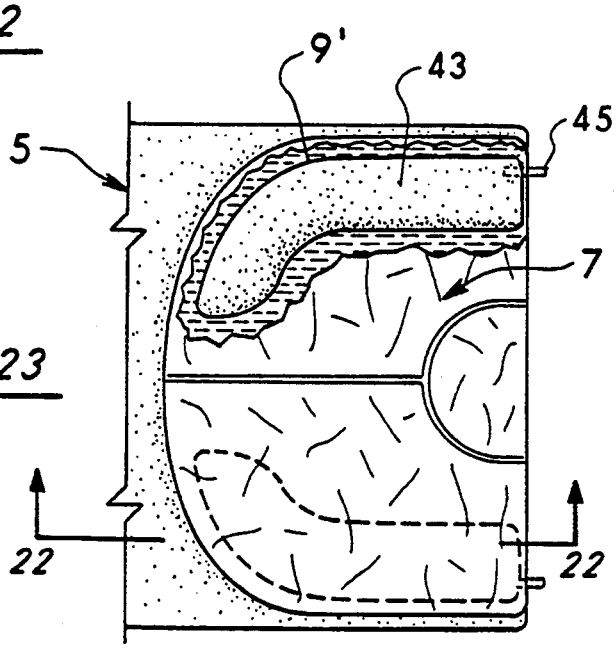
Fig. 23

SELF-ADJUSTING SEATING SYSTEM

BACKGROUND OF THE INVENTION

1. Field of the Invention

This invention relates to the field of seating systems and more particularly to the field of seating systems for wheelchairs.

2. Discussion of the Background

It is known and well documented that persons confined for extended periods of time to seating systems (particularly seating systems for wheelchairs) are subject to and at risk of developing decubitus ulcers or pressure sores. These pressure sores normally occur in the tissue surrounding or adjacent to the bony prominences of the skeletal structure and are due to the pressure applied to them by the weight of the seated person. That is, the tissue between the seated person's bones and the seating surface is normally squeezed under the user's weight. As a result, the normal flow of blood through the capillary vessels to the squeezed tissue areas can become occluded or blocked. Continued pressure and the resulting lack of blood flow to the tissue will cause necrosis (dead tissue) to form and in the most severe cases may cause an open wound from the epidermis (skin) all the way down through the fatty and muscular tissue to an exposed bone. Unattended, the decubitus ulcers (pressure sores, wounds) may become infected and eventually may even become fatal to the seated person. The most common areas of pressure sore development are the ischial tuberosities and the coccyx (tailbone).

There have been numerous prior art approaches developed to specifically deal with the problems of users confined to seating systems over long periods of time such as wheelchair users. One such prior art approach is disclosed in the present assignee's U.S. Pat. No. 4,588,229. This approach has proven to be effective in reducing the risk of pressure sores or ulcers as well as providing stable and comfortable positioning for the user. In it, a seating system is provided consisting essentially of a relatively rigid, shaped tray or base member and a fluid pad member. The tray or base member is contoured to provide a seating well to accept the bulk of the fluid pad. The fluid pad is designed to conform to the precise shape of the seated user and in doing so, the interface pressures where the fluid pad contacts the user are significantly reduced to safe levels. The bulk of the fluid pad is concentrated about the high risk, boney prominences (i.e., ischial tuberosities, coccyx, and trochanters). In these areas, it is desirable to achieve as much surface contact as possible between the buttocks and the fluid paid to thereby lower the average interface pressure.

This goal of low interface pressure is achieved in such prior art approaches by optimizing the amount of depth immersion of the user into the fluid pad. For example, when only small amounts of depth immersion are occurring (e.g., with a person having a relatively flat buttocks with minimal boney protuberances or with an overfilled pad), the solution is usually to remove some of the fluid from the pad to allow the user's buttocks to sink farther into the fluid pad. This increases the surface contact area and, in turn, favorably reduces the average interface pressure. Conversely, if there is too much depth immersion and the user bottoms out or nearly bottoms out on the rigid tray, pressure sores or ulcers may develop. In such cases, fluid is usually added to the fluid pad to safely support the user's buttocks on a layer of fluid instead of the rigid tray.

Proper sizing of the tray and fluid fill of the pad in such prior art approaches is critical in determining whether the user will bottom out or otherwise fail to achieve optimum pressure relief. The size of such trays should approximately match the seated width of the user. The amount of fluid fill of the pad has largely been determined to date by trial and error using essentially a standard sized person for a given seated width. The nominal fill amount so determined then adequately serves the majority of such users. However, when bottoming out is observed, corrective action must be taken such as adding more fluid to the pad or placing a discrete pouch or pouches of fluid between the fluid pad and the rigid tray. Unfortunately, this can become a fitting nightmare requiring costly and time-consuming visits to a physical therapist and customized, special orders and possibly re-orders. Even then, the optimum pressure relief may still not be achieved: or, a user may gain or lose weight and buttocks mass and a previously properly fitted pad may become ill fitting. Further, the user may have little or no feeling in his buttocks and may not know his seating system is improperly fitted until dangerous decubitus ulcers begin to develop.

The basic problem with all known prior art approaches including liquid and air filled ones is that there is no way to fully anticipate the exact size, weight, and shape of the user's buttocks. Consequently, some current seating systems simply provide a standard fill (or progressions of standard fills) that will prevent bottoming out for the majority of users. Other current seating systems require that the user himself make adjustments to the working fluid (e.g., adding liquid or pumping exhausting air). The first-mentioned systems are simply a compromise and in many cases will not optimize the pressure relief. The second approach may introduce and usually does introduce adjustment errors that may result in less than optimized pressure relief.

With the above in mind, the self-adjusting seating system of the present invention was developed. With it, pressure relief can be optimized automatically without any fill or other adjustments required.

SUMMARY OF THE INVENTION

This invention involves a seating system primarily intended for use with wheelchairs. The seating system includes a relatively rigid, shaped tray and a fluid pad. The tray has a forward section to support the user's thighs and a rearward section with a depressed, contoured seating well to support the user's buttocks including his ischial tuberosities. The seating well includes a bottom portion and a U-shaped rim portion extending about it. The fluid pad contains a fixed volume of incompressible fluid and is provided and dimensioned to be bunched up and received in the seating well of the tray.

The seating system is self-adjusting and automatically properly fits a user based on his weight. This is accomplished in the preferred embodiments by adding a layer of resilient, compressible foam over the upper surface of the rim portion of the seating well between the fluid pad and the rim portion. The foam is dimensioned and chosen to selectively occupy varying amounts of the volume of the seating well (i.e., creating an effective seating well volume) in proportion to the weight of the user. For heavier users, the foam compresses more to meet the demands of such a user for a larger effective seating well volume. Conversely, for a lighter user, the foam is compressed less and presents a larger effective seating well volume to properly fit the lighter user under a safe minimum thickness of fluid.

In one embodiment, the foam layer is a continuous band extending over the rim portion of the seating well. In other embodiments, the foam layer is discontinuous and includes two portions or legs spaced from each other across the bottom portion of the seating well forming a first gap and leaving the bottom portion uncovered. A second gap is also formed between the ends of the legs at the base of the U-shaped rim portion for the comfort of the user and for the addition of an abductor if desired. In the preferred embodiments, the foam layer is enclosed in waterproof, airtight material which has vents to allow the air from the compressed, open-celled foam layer to vent to atmosphere.

The foam layer and fluid pad in the preferred embodiment is a single, one-piece unit with portions of the fluid pad positioned atop the foam layer. In another embodiment, the enveloped legs of the foam layer are positioned within the fluid pad itself. In all embodiments, the resulting seating system is self-adjusting and automatically modifies the effective seating well volume of the tray in proportion to the user's weight for a safe and proper fit.

BRIEF DESCRIPTION OF THE DRAWINGS

FIGS. 13 and 14 schematically show cross-sectional, side views of the fleshy and atrophied users of FIGS. 11 and 12 on the self-adjusting seating system of the present invention. In both cases of FIGS. 13 and 14, the fleshy and atrophied users are comfortably and properly supported under both their thighs and buttocks.

FIG. 17 shows the tray's contoured upper surface and the respective areas of the tray intended to support the user's ischial tuberosities, coccyx, and femurs including the trochanters.

FIG. 18 is a slightly exploded, schematic view of a portion of the seating system illustrating the envelopes of waterproof, airtight material respectively enclosing the fluid of the fluid pad and enclosing the foam layer.

FIG. 19 is an enlarged, schematic view taken along line 19—19 of FIG. 18 illustrating the arrangement for venting air to atmosphere through the envelope surrounding the foam layer.

FIG. 20 illustrates another embodiment of the present invention in which the continuous band of foam of FIG. 3 is made in two parts or legs spaced from each other and individually enclosed in waterproof, airtight material.

FIG. 21 is a cross-sectional view taken along line 21—21 of FIG. 20.

FIG. 22 is a schematic, cross-sectional side view of a further embodiment of the present invention in which the legs of the resilient, compressible foam layer of FIG. 20 are positioned inside the fluid pad. FIG. 22 is taken along line 22—22 of FIG. 23.

FIG. 23 is a view taken along line 23—23 of FIG. 22.

DETAILED DESCRIPTION OF THE PREFERRED EMBODIMENTS

Figure 1:
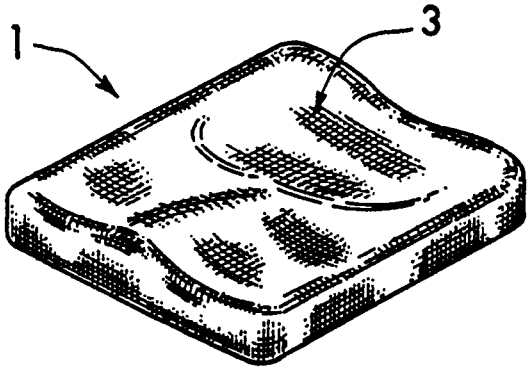
FIG. 1 is a view of the covered seating system of a first embodiment of the present invention.
Figure 2:
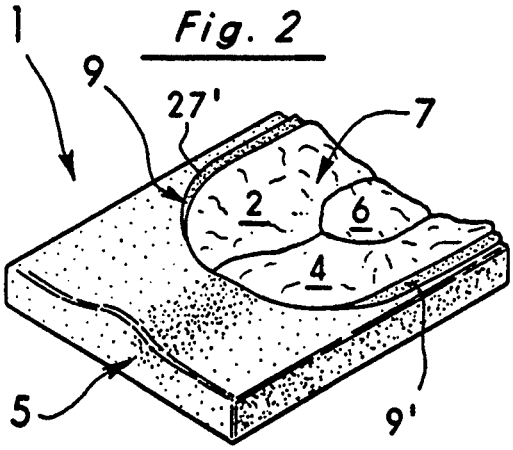
FIG. 2 is a view of the self-adjusting seating system of FIG. 1 with the cover removed to show the underlying tray or base member and to show the fluid pad and intermediate foam layer which are positioned on the tray. The cover is also not shown in the remaining figures for clarity.
Figure 3:
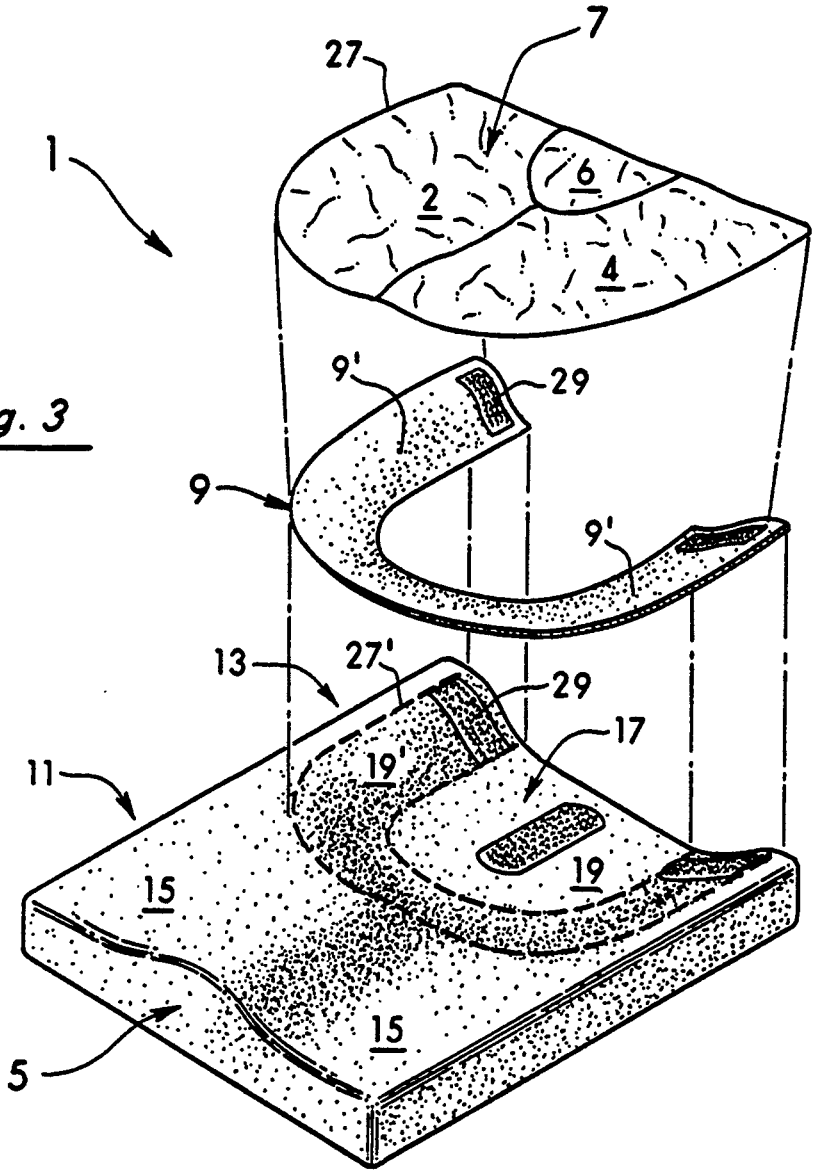
FIG. 3 is an exploded view of the tray or base member, fluid pad, and intermediate U-shaped layer of resilient, compressible foam. The intermediate foam layer as shown is positioned between a portion of the fluid pad and the tray.

The seating system 1 of the present invention in its simplest form is shown in FIGS. 1–3. In this embodiment, the seating system 1 includes an outer cover 3 (see FIG. 1) positioned over a tray or base member 5 (see FIGS. 2 and 3) which supports a fluid pad 7 and an intermediate layer 9 of resilient, compressible foam.

Figure 17:
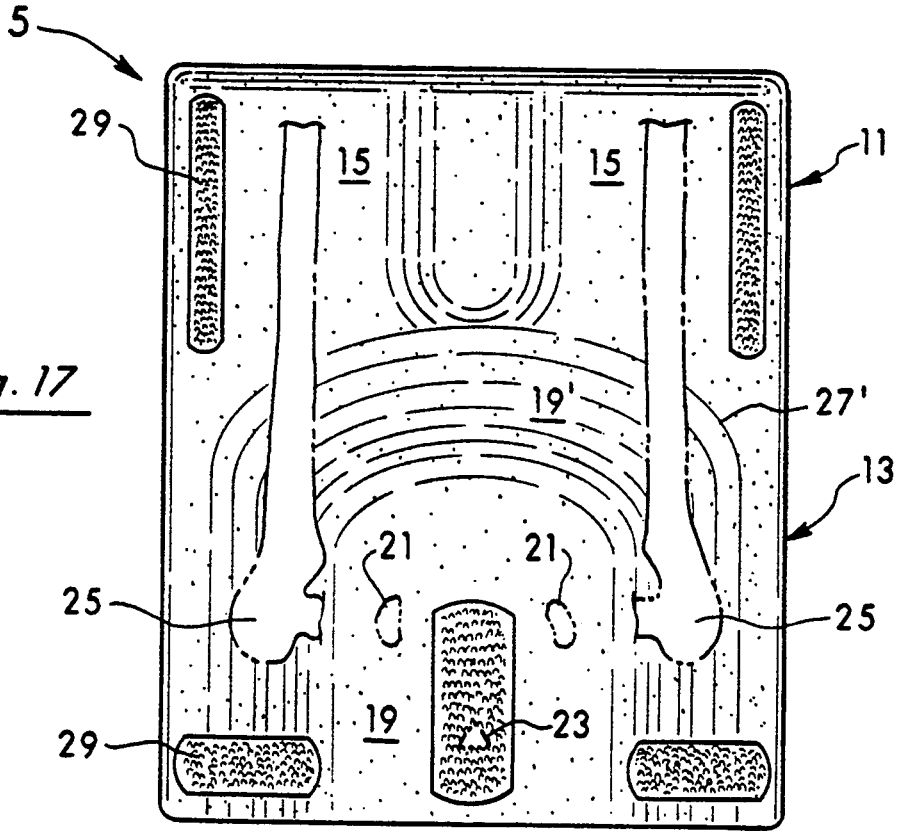
FIG. 17 is a top plan view of the relatively rigid, shaped tray or base member of FIG. 15.

The shaped tray 5 is preferably made of relatively rigid, closed-cell foam (e.g., cross-linked polyethylene) but can be made of other relatively rigid and relatively incompressible structural materials such as plastic, wood, or metal which will hold its shape in use. The tray 5 as best seen in FIGS. 3, 13, and 17 has a forward section 11 and an immediately adjacent rearward section 13. The forward section 11 has an upper surface 15 forming a shelf to support the user's thighs (see FIG. 13). The rearward section 13 (see FIG. 3) has a depressed, contoured seating well 17 with an upper surface at 19 and 19' intended to support the user's buttocks including his or her ischial tuberosities 21 (see FIGS. 13 and 17), coccyx 23, and trochanters 25. As best seen in FIG. 3, the seating well or bowl 17 has a bottom portion whose upper surface is 19 and a rim portion whose upper surface is 19'. The upper surface 19' of the rim portion extends in substantially a U-shape upwardly from (e.g., at about 45 degrees) and about the upper surface 19 of the bottom portion of the seating well 17. Together, the upper surface 19 and 19' form the upper surface of the depressed seating well 17.

The layer 9 of resilient, compressible material as shown in FIG. 3 in the simplest form of the invention is a substantially U-shaped band dimensioned to substantially conform to the upper surface 19' of the rim portion of the seating well 17. In this manner, the U-shaped band 9 essentially covers the upper surface 19' but leaves the upper surface 19 of the bottom portion of the seating well 17 uncovered. In other words, the U-shape of the layer 9 and in particular the legs 9' thereof are spaced from each other to leave a gap therebetween.

The gap as shown extends substantially across and completely over the upper surface 19 of the bottom portion of the seating well 17. The significance of this gap across upper surface 19 will be discussed later. The layer 9 in contrast to the stiff, rigid tray 5 is preferably made of resilient, compressible material such as soft polyurethane foam that is open-celled and vents air as it is compressed. In the preferred embodiment, the foam layer 9 is enclosed in an envelope of waterproof, airtight material to protect the foam from absorbing bodily fluids and other fluids. However, in the simplest form of the invention of FIGS. 1–3, the foam layer 9 is not enclosed and simply vents air around the fluid pad 7 (see FIG. 2) adjacent the perimeter 27' of the seating well 17 (see FIGS. 2 and 3) when the foam layer 9 is compressed under the user's weight. The vented air then simply passes through the air permeable cover 1 of FIG. 1 to atmosphere.

The fluid pad 7 as seen in FIGS. 2 and 3 is preferably made up of three subsections or pouches 2, 4, and 6 but could be just one section or pouch within the border 27 of the fluid Dad 7. The fluid pad section (whether just one section or plural subsections 2, 4, and 6) contains a substantially incompressible fluid preferably with a viscosity of at least one and more preferably, the fluid is a highly viscous liquid such as disclosed in U.S. Pat. No. 4,588,229. Such preferred liquids exhibit non-resilient, non-restoring properties typical of plastic or viscous thixotropic materials which flow gradually when pressure is applied to them but which maintain their shape and position in the absence of pressure. However, other highly viscous fluid such as gels, oil, or grease can also be used. Additionally, the section including its subsections 2, 4, and 6 (which may be made of layers of thermoplastic film material such as polyurethane) are preferably only partially filled (e.g., 40% to 70%) with fluid so that there is no distending or tensioning of the fluid pad section 7 including its subsections 2, 4, and 6 in use.

In the preferred embodiments, the subsections 2 and 4 are respectively positioned under the left and right ischial tuberosities 21 and trochanters 25 and the subsection 6 is positioned under the coccyx 23. Also, the fluid pad 7 is preferably oversized relative to the seating well 17 of the tray or base member 5, particularly toward the rear of the seating well 17. In use (compare FIGS. 2 and 3), the fluid pad 7 is essentially bunched together (particularly in the rear) and positioned over the upper surface 19 and 19' of the seating well 17 and the foam layer 9. In the simplest form of the invention of FIGS. 1–3, the fluid pad 7 and foam layer 9 can be held in place under their own weight or preferably by, for example, hook and loop fasteners 29 on respective abutting top and underside surfaces of the tray 5, foam layer 9, and fluid pad 7.

Prior Art Illustration of the Problem

FIGS. 4–9 illustrate prior art seating systems and some specific problems with them that led to the present invention. More specifically, FIGS. 4–9 show some currently available seating systems in which a fluid pad such as 7 is positioned directly over a relatively rigid, shaped tray such as 5. (The cover such as 3 of FIG. 1 is not shown in these FIGS. 4–9 for clarity).

Figure 4:
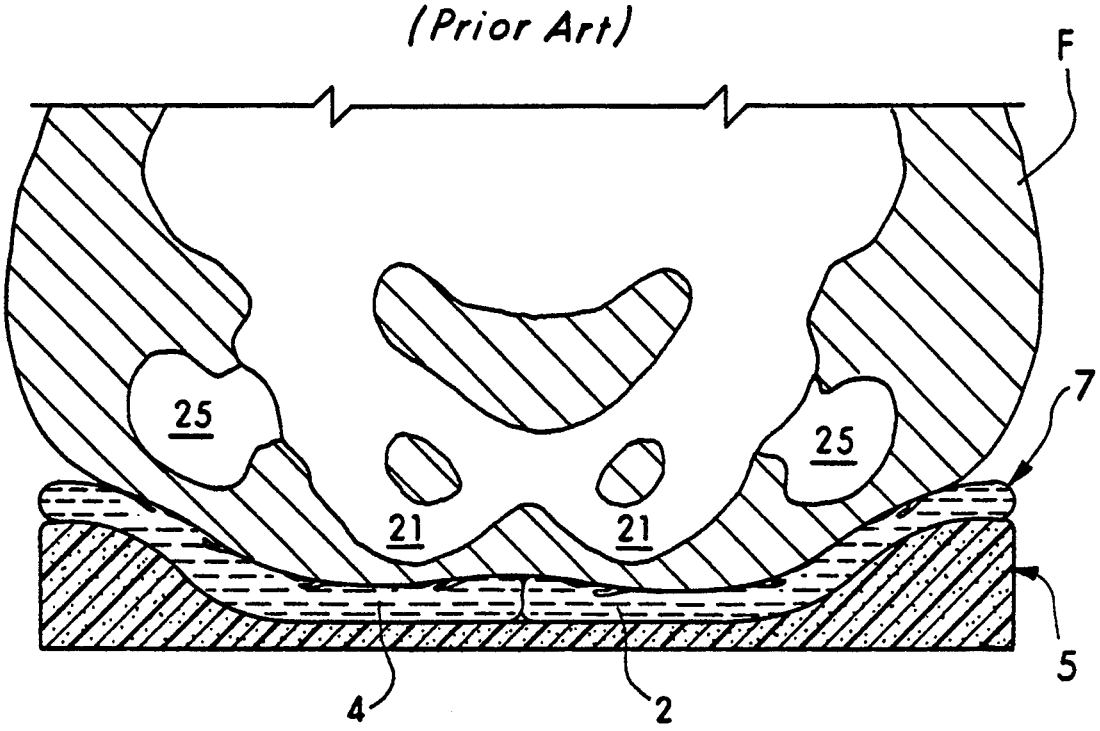
Fig. 4 (Prior Art)
FIGS. 4–9 illustrate prior art seating systems and some of the problems with them that are overcome by the present invention.

In FIG. 4, a relatively fleshy user F is shown on the prior art seating system of tray 5 and fluid pad 7 in a properly fitted position. In it, his boney prominences and in particular, his ischial tuberosities 21 are supported in a proper manner on a minimum safe level (e.g., ½ inch) of fluid in the fluid pad 7. However, if an atrophied user A with the same pelvic bone size as the fleshy user F of FIG. 4 were to sit on the same seating system of FIG. 4 and in particular, the same fluid pad 7, a problem immediately arises. More specifically, the atrophied user A would bottom out his ischial tuberosities 21 on the rigid tray 5 (see FIG. 5). The same would happen if the fleshy user F of FIG. 4 himself were to atrophy or lose significant portions of his fleshy tissue. In either case, such bottoming out is a completely unacceptable condition and may quickly lead to the development of decubitus ulcers.

Figure 5:
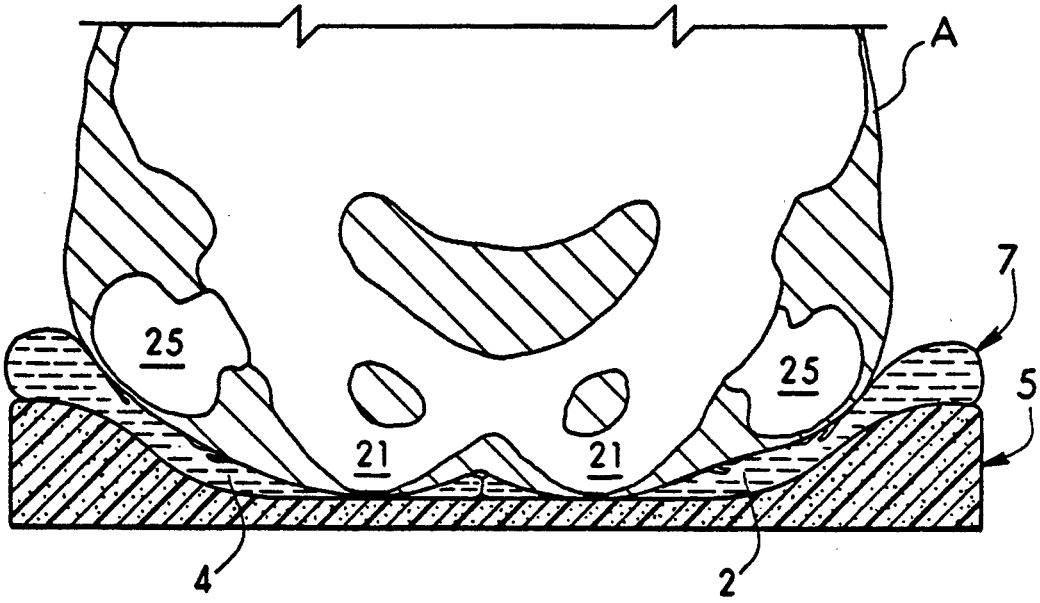
Fig. 5 (Prior Art)
Figure 6:
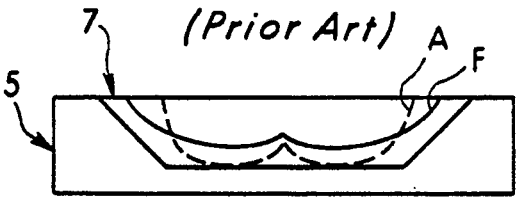
Fig. 6 (Prior Art)
Figure 7:
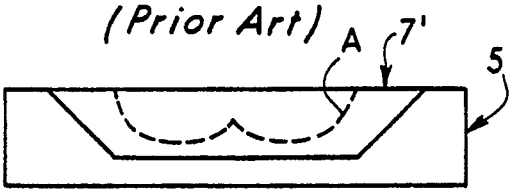
Fig. 7 (Prior Art)

The problem is that the atrophied user A of FIG. 5 has less fleshy tissue around his boney prominences and less mass or size to his buttocks. Consequently, as shown schematically in FIG. 6, where the fleshy user F (shown in solid lines) is properly supported on at least ½ inch of fluid in the fluid pad 7, the atrophied user A (shown in dotted lines) will sink into the same fluid pad 7 farther and will bottom out as seen in FIG. 6. In current practice, the most common solution to this problem is to provide the atrophied user A with a fluid pad 7' with more fluid (see FIG. 7). Unfortunately, this solution can become a fitting nightmare in the field. That is, the atrophied user A is typically sized in the field by adding a discrete fluid pouch or pouches under the fluid pad 7 until he does not bottom out. The number of such discrete pouches needed to properly fit the atrophied user A is then commonly called back to the supplier who custom makes an appropriately overfilled fluid pad 7'. The overfilled pad 7' is then sent to the user who may require one or more additional fittings and reorders until the proper fit is achieved. This is obviously a costly and time consuming process. Also, the addition of fluid to the pad 7' adds significant amounts of weight and material costs as the preferred fluid is a highly viscous and relatively heavy and expensive fluid.

Figure 8:
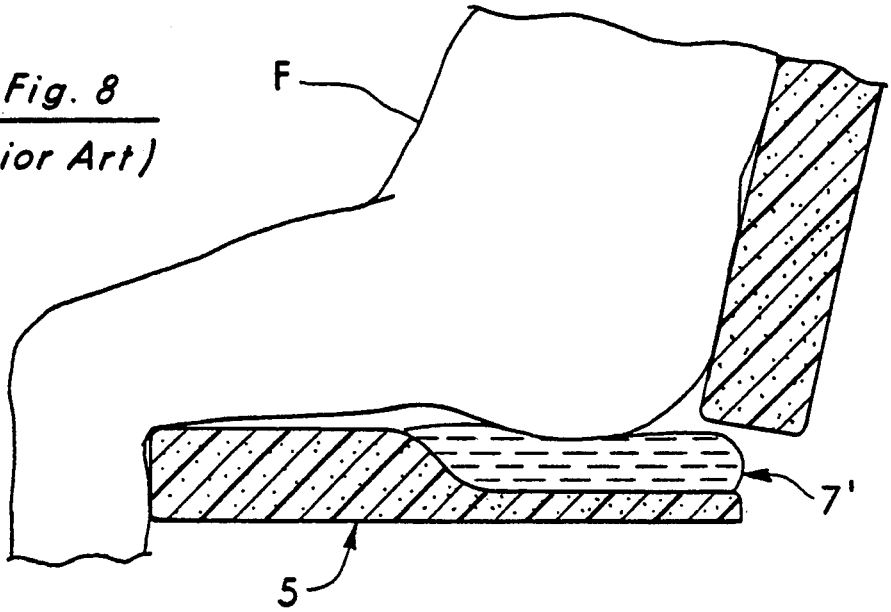
Fig. 8 (Prior Art)
Figure 9:
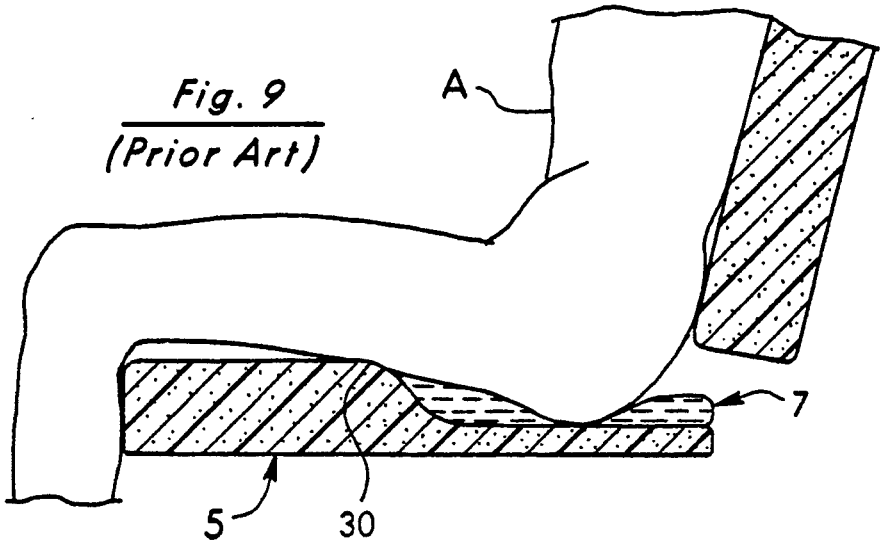
Fig. 9 (Prior Art)

Further, should the fluid pad 7' be overfilled too much for the atrophied user A (or should the fleshy user F of FIG. 4 use the atrophied user's overfilled fluid pad 7' as shown in FIG. 8), the user's buttocks sit too high. More importantly, his thighs (where as much weight should be supported as possible) are largely unsupported. Conversely, should the fluid pad 7 be underfilled too much (or should the atrophied user A of FIG. 5 try to use the fleshy user's fluid pad 7 as shown in FIG. 9), the user's buttocks may bottom out. Additionally, his thighs will also be largely unsupported and may even have a dangerously high pressure contact at 30 right at the top of his thighs. In both cases, undesirably high pressures possibly leading to decubitus ulcers may develop on the user's buttocks under his boney prominences. The above fitting problems may also obviously develop for the same user over time if he simply gains or loses significant weight and fleshy tissue in his buttocks. Unfortunately, in many cases, the user may have little feeling in his buttocks and may not know he is bottoming out or nearly bottoming out until decubitus ulcers begin to develop.

Solution

Figure 10:
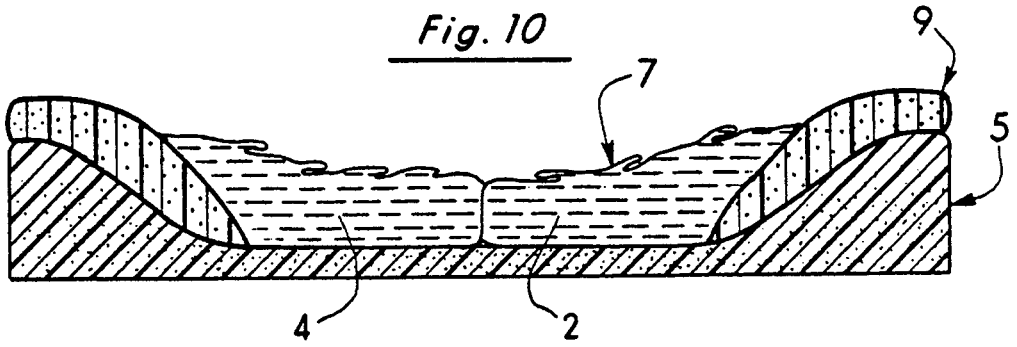
FIGS. 10–12 illustrate in slightly exaggerated scale the fundamental concept behind the self-adjusting seating system of the present invention. As shown, the layer of resilient, compressible foam between the fluid pad and the relatively rigid tray in FIG. 10 automatically adjusts the seating system to accommodate both fleshy (FIG. 11) and atrophied (FIG. 12) users of the seating system. In both cases of FIGS. 11 and 12, the fleshy and atrophied users on the seating system of FIG. 10 are comfortably and properly supported automatically on at least a safe minimum thickness of fluid.
Figure 11:
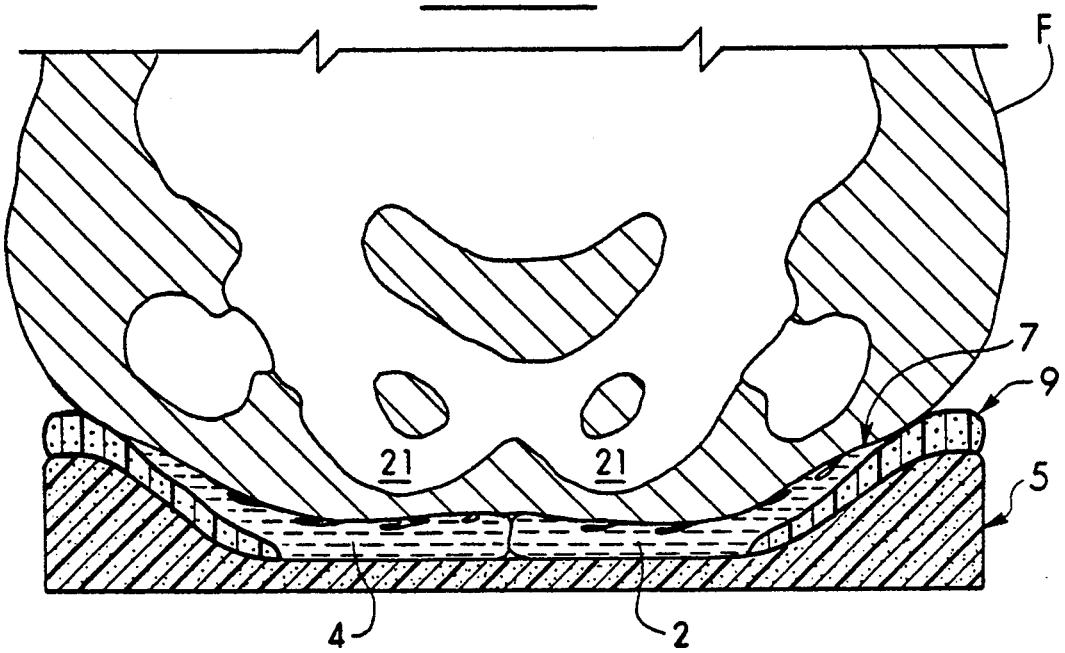
Figure 12:
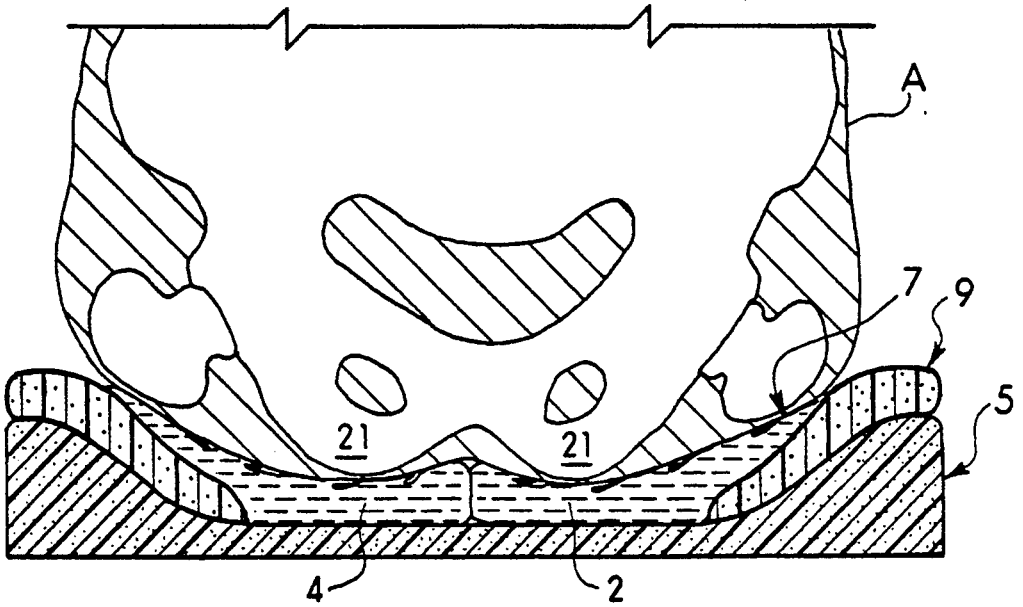

FIGS. 10–12 illustrate in slightly exaggerated terms the fundamental concept behind the present invention. More specifically, it was surprisingly discovered that the insertion of a layer 9 of resilient, compressible material unexpectedly solved the fitting problems of FIGS. 4–9. In essence, the incorporation of the foam layer 9 in the seating well 17 of the tray 5 unexpectedly had the effect of serving as a fluid volumetric accumulator. In doing so, the foam layer 9 served to automatically regulate the ratio of the fluid volume in pad 7 to the effective seating well volume of 17 based on the size and weight of the user.

In simplest terms, the fluid volume of the pad 7 is normally designed to substantially equal the seating well volume of 17 less the anticipated average volume of a user's buttocks immersed in the fluid pad 7. This is normally determined with a safe minimum thickness (e.g., ½ inch) of fluid still remaining between the user's ischial tuberosities 21 or immediately adjacent tissue and the rigid tray 5. In this regard, a generalization can be made that the heavier a user is, the fleshier his buttocks will be. Consequently, the heavier user will require more seating well volume to immerse his buttocks to the maximum amount (to optimize interface pressures) and still have a safe thickness (e.g., ½ inch) of fluid under his ischial tuberosities. Similarly, a lighter user generally has less fleshy tissue (e.g., muscle and fat) and will require less available seating well volume to properly immerse his buttocks to optimize relief pressure while maintaining a safe minimum fluid level above the rigid tray.

By way of specific example, a fleshy user F weighing 200 pounds may have his buttocks displace or occupy 100 cubic inches within the volume of seating well 17 on a given fluid pad 7. This is with a resulting minimum fluid level of ½ inch between his ischial tuberosities and the rigid tray 5. In contrast, a lighter or atrophied user A may displace or occupy only 75 cubic inches of the seating well volume 17. In this example, both users F and A have roughly the same pelvic bone size and require the same width and length tray 5. That is, for the most part (and with the notable exception of obese users), such tray sizing is purely a function of bone or skeletal size and not a function of fleshy tissue mass. In this light, if the same tray 5 for users F and A has an empty seating well volume 17 of 200 cubic inches, then the fleshy user F needs a fluid pad volume of 100 cubic inches (i.e., seating well volume of 200 cubic inches less immersed buttocks volume of 100 cubic inches). The atrophied user A, on the other hand, requires a fluid pad volume of 125 cubic inches to be properly supported with a minimum safe level of ½ inch of fluid between his buttocks and the rigid tray 5. If the atrophied user A were to sit on the fluid pad 7 for the fleshy user F, the atrophied user A would bottom out as discussed above in reference to FIGS. 4–9 and in particular, FIGS. 6 and 9.

To solve this problem, it was unexpectedly discovered that the addition of a layer 9 of resilient, compressible foam within the seating well 17 would act as a fluid volumetric accumulator. In doing so, the layer 9 automatically regulated the ratio of fluid volume in the pad 7 to the effective seating well volume of 17 based on the size and weight of the user. Again, in simplest terms, the existing problem is that the fluid pad volume of 7 and immersed buttocks volume of the user are roughly equal to the seating well volume of 17. Consequently, for the same bone-sized users using the same fluid pad 7 with a fixed volume of fluid and using the same sized tray (remembering a tray is properly fitted to bone size), the heavier user F requires a larger seating well volume than the atrophied user A. For a given tray size and a given fluid pad, the optimum seating well volume is thus proportional to the user's weight. Yet, most given tray sizes are provided with the same seating well volume. In this light, it was unexpectedly discovered that with the addition of foam layer 9, this problem was overcome. More specifically, with the addition of resilient, compressible foam layer 9 that is compressed in proportion to the user's weight, the effective seating well volume (i.e., seating well 17 volume less the volume occupied by the foam layer 9) also will vary in proportion to the user's weight. The net result is that for the same tray 5 and same fluid pad 7 (see FIG. 10), both the heavier user F (see FIG. 11) and atrophied user A (see FIG. 12) are automatically properly fitted with a minimum safe thickness (e.g., ½ inch) of fluid between their buttocks and the rigid tray 5. In both cases, the resilient, compressible layer 9 of foam automatically adjusted the effective well volume of the tray 5.

To accomplish this, the volume and compressibility or compression rate of the foam layer 9 are simply picked so that, in our example, the volume of the foam layer 9 compresses 25 cubic inches more under the 200 pound user F than under the 125 pound user A. Continuing this example, the uncompressed volume of the foam layer 9 of FIG. 10 might then be picked to occupy 50 cubic inches and the compression rate selected such that the foam layer 9 compressed to 15 cubic inches under the heavier user F of FIG. 11 and compressed to 40 cubic inches under the atrophied user A of FIG. 12. This then produces the desired, compressed volume difference of 25 cubic inches between the applications of FIGS. 11 and 12. It also does so with relatively light weight and low cost foam versus the prior art approach of making up the 25 cubic inches with a highly viscous and relatively heavy (e.g., 10:1 heavier than foam) and expensive liquid. The layer 9 has also been found to proportionally produce the desired volume differences for users other than the 200 pound and 125 pound users of our example.

Alternately, this result could be achieved by fixing the compression rate of foam layer 9 and then determining the total foam volume for that rate needed to obtain the required volume change for users F and A. A stiffer foam, for example, would require a larger, initial volume of layer 9. In contrast, a softer foam with a very high compression rate would enable a smaller volume of foam to be used but would require a greater percentage of volume compression (e.g., 90% for the heavier user F in FIG. 11). Durability and longevity of the foam generally degrade the more the resilient foam is compressed. Consequently, it is preferred that the maximum compression limit (e.g., see FIG. 11) of the foam layer 9 be no more than to about 50%–60% of the original volume for the heaviest user. Preferably, the foam layer 9 is then compressed about 40% from the original volume in FIG. 11 under the heavier user F and about 10% in FIG. 12 under the lighter user A.

The foam layer 9 is preferably not positioned over the surface 19 of the bottom portion of the seating well 17. This positioning away from surface 19 is preferred as positioning over surface 19 would generally require that the vertical depth of the seating well 17 and sides of the tray 5 about the seating well 17 be increased. That is, it is desirable that the overall height of the tray 5 be as short as possible (e.g., for stability and minimum overall size and weight) and adding foam over the surface 19 only adds height for any given tray 5 and fluid pad 7. Additionally, too much foam may create an unstable seating system that is too springy or bouncy. This is primarily why the foam layer 9 is preferably positioned away from the surface 19 and only about the surface 19' of the rim portion of the seating well 17 under the fluid pad 7. In this regard, the viscous fluid of the pad 7 overlapping the foam layer 9 will also serve to dampen the normal dynamic responses or springiness of the underlying resilient foam layer 9.

Preferred Embodiment of FIGS. 15–19

The preferred embodiment of the present invention is shown in FIGS. 15–19. In it, the fluid pad 7 and foam layer 9 have been combined into a single, one-piece unit (see the top and bottom views of FIGS. 15 and 16) positionable over the upper surface of the tray 5. Additionally, the basic fluid pad section 7 and foam layer 9 have both been provided with forward extending portions 8 and 10 that fit over the forward section 11 of the tray 5 under the user's thighs. These forward extending portions 8 and 10 as well as the side extending portions 12 of the fluid pad section 7 are in addition to and do not affect the fundamental operation of the fluid pad section 7 and foam layer 9. In this regard, fluid pad section 7 and foam layer 9 of the preferred embodiment function the same as those in the simplified embodiment of FIGS. 1–3. Similarly, the preferred embodiment of FIGS. 15–19 would also have an air permeable cover such as 3 in FIG. 1 but it is not shown in these FIGS. 15–19 for clarity.

As in the embodiment of FIGS. 1–3, the fluid pad section 7 within the area bounded by seal 27 is oversized relative to the seating well 17. In use, subsections 2, 4, and 6 of the fluid pad section 7 are then bunched together over the upper surface 19 and 19' of the seating well 17 and the foam layer 9. Additionally, the entire one-piece unit of pad 7 and foam layer 9 in FIGS. 15 and 16 with their forward extending portions 8 and 10 and side extending portions 12 is slightly oversized relative to the entire tray 5. Such oversizing prevents hammocking and is primarily done from side-to-side versus front-to-rear in order to prevent the pad 7 from simply bulging out the open back of the seating well 17 when used. Hook and loop fasteners 29 further help to properly position and hold the pad 7 in place to prevent any such bulging out the back. The open back of seating well 17 is preferred for the safety and comfort of the user.

By way of example, the dimensions of the tray 5 of FIG. 17 for an adult user may be fourteen to twenty-four inches across and sixteen to twenty inches from front to rear. The one-piece unit of members 7–10 and 12 of FIGS. 15 and 16, in turn, may be fourteen to twenty-six inches across the front (e.g., to allow for accessories such as abductors and adductors), eighteen to twenty-two inches from front to rear, and fourteen to thirty-six inches across at the rear. In use, the one-piece unit as discussed above is essentially bunched together at the fluid subsections 2, 4, and 6 giving an overall rectangular shape to the one-piece unit that corresponds to the shape of the upper surface of the tray 5. Thereafter, the one-piece unit is positioned on the upper surface of the tray 5 and held in place by its own weight or preferably by, for example, hook and loop fasteners 29. In this manner, the perimeter of the one-piece unit of 7–10 and 12 is aligned with and positioned or secured substantially over the perimeter of the tray 5. More importantly, the perimeter 27 of the fluid pad section 7 is aligned with and positioned or secured substantially over the perimeter 27' of the upper surface 19' of the rim portion of the seating well 17. In doing so, the area enclosed by the perimeter 27 of the fluid pad section 7 of the one-piece unit of FIGS. 15–19 (and the corresponding perimeter 27 in the embodiment of FIGS. 1–3) is substantially larger (e.g., 50% to 100% or more) than the area enclosed by the perimeter 27' of the seating well 17. In the preferred embodiment, there is no additional fluid in the forward extending portions 8 but fluid could be added to them if desired.

Figure 15:
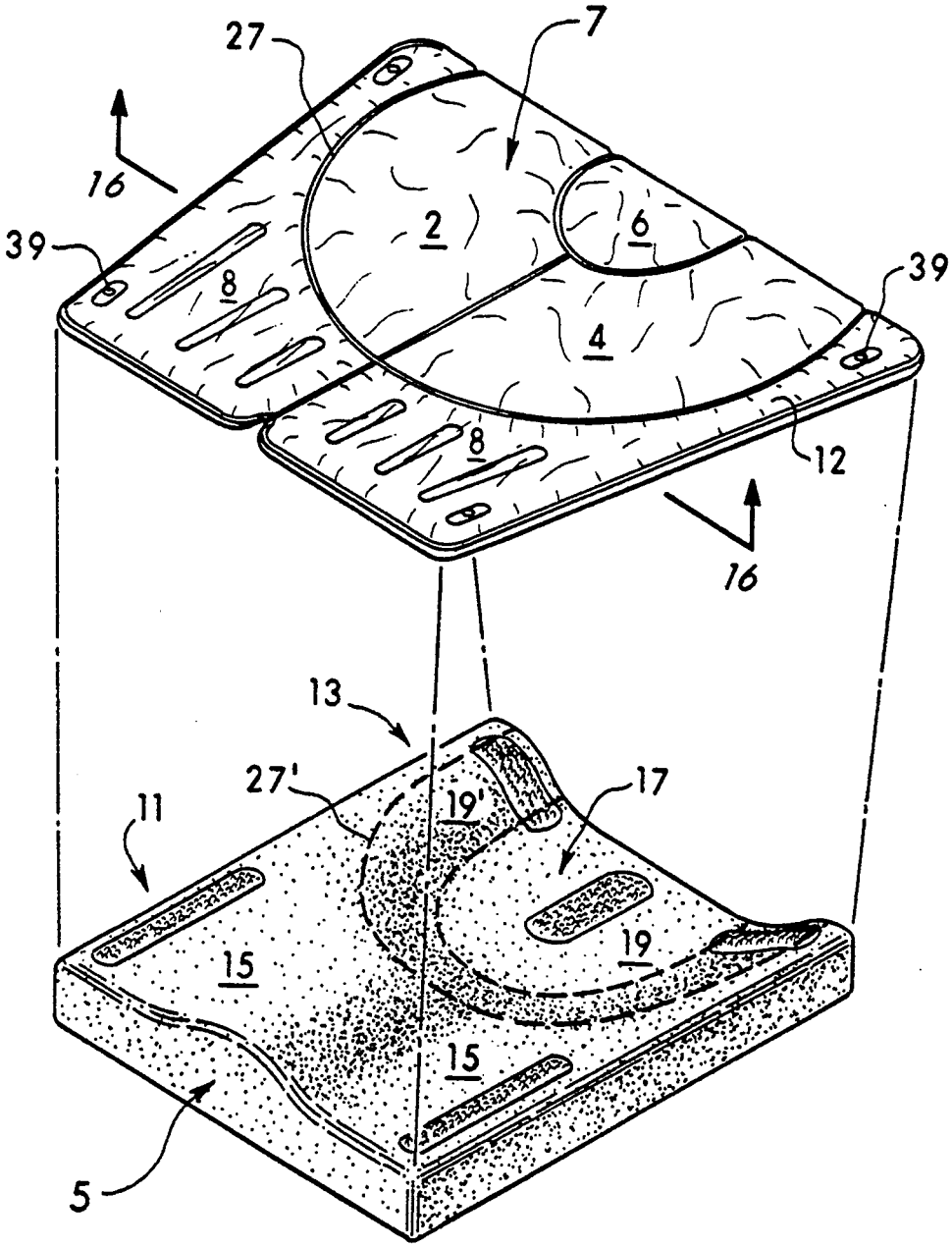
FIG. 15 is an exploded view similar to FIG. 3 showing the preferred embodiment of the present invention. In it, the layer of resilient, compressible foam is secured beneath the fluid pad to form a one-piece unit.
Figure 16:
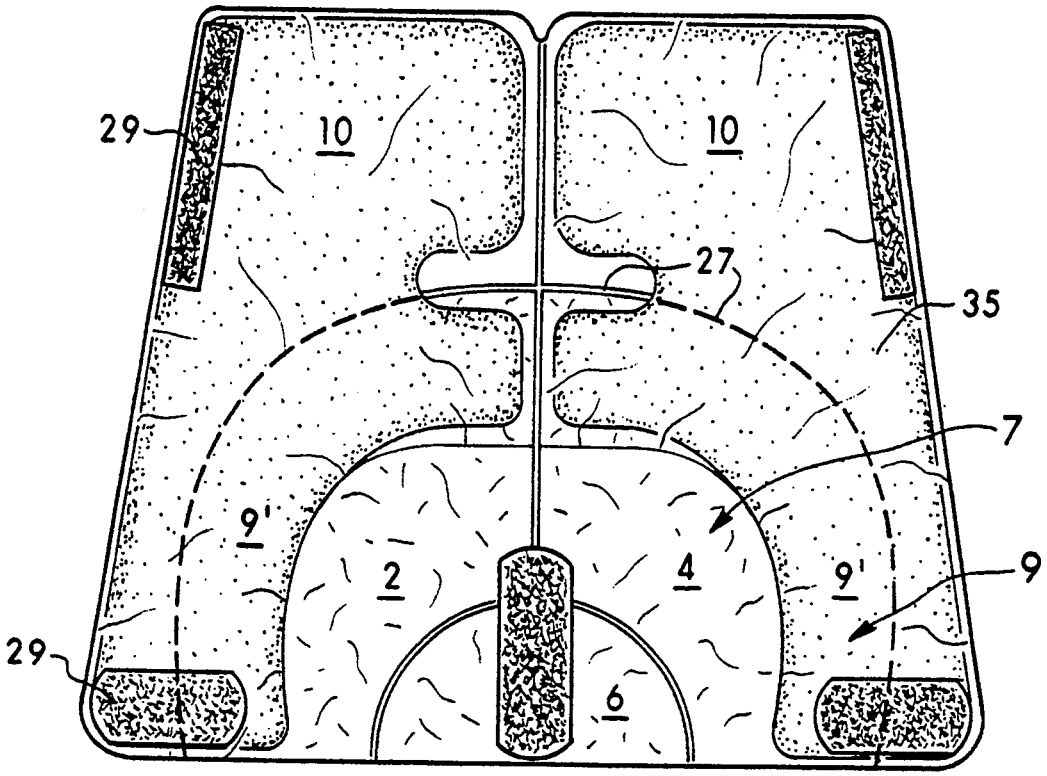
FIG. 16 is a bottom plan view of the fluid pad and foam unit taken along line 16—16 of FIG. 15.

The foam layer 9 of the preferred embodiment of FIGS. 15–19 is enclosed in an envelope 31 of waterproof, airtight material (e.g., thermoplastic film such as polyurethane). This envelope 31 is best seen in the slightly exploded view of FIG. 18 and includes at least upper and lower members 33 and 35. Upper member 33 in FIG. 18 can be part of the envelope of waterproof, airtight material enclosing the fluid in the fluid pad 7 and/or secured to the fluid pad envelope at heat seal 27. These envelope members can be composed of multiple layers if desired for strength and puncture-leak resistance. In any event, the open-celled foam of layer 9 vents air when compressed and this air exit to atmosphere through the staggered holes 37 and 39 (see FIG. 19) in the respective upper member 33 of envelope 31 and side portion 12 extending outwardly of the fluid pad section 7. These holes 37 and 39 as best seen in FIG. 18 (see also FIG. 15) are positioned outwardly of the perimeter seal 27 of the fluid pad section 7 so as not to be blocked or closed when the user sits on the seating system. Additional holes 39 are also provided in the portions 8 forward of the fluid pad section 7. As seen in FIG. 15, the vent holes 39 are essentially positioned in the far corners of the unit where they are least likely to be covered up by the user.

In operation, the seating well 17 then has a first volume roughly defined by the rim portion perimeter 27' and a vertical plane extending across the open back of the tray 5. The fluid pad 7 in turn has a second volume defined by the fixed volume of incompressible fluid in pouches or subsections 2, 4, and 6. This fluid pad section 7 of subsections 2, 4, and 6 (which could also be just a single section or pouch filling all or just a portion of the area bounded by 27) is then bunched together and positioned substantially within the first volume of the seating well 17. Additionally, foam layer 9 of all of the embodiments is preferably positioned between the upper surface 19' of the seating well 17 and at least a portion of the fluid pad section 7. The foam layer 9 thus occupies part on the volume of the seating well or first volume 17. In use, the foam layer 9 will be compressed and will thus occupy varying amounts of the seating well or first volume 17 in proportion to the weight of the user supported on the upper surface 19 and 19' of the seating well 17. More specifically, the foam layer 9 acts as a varying means and will occupy less of the seating well or first volume 17 as the supported weight increases. In perhaps more descriptive terms, the first volume of the seating well 17 less the volume occupied by the foam layer 9 defines an effective seating well volume. In use, the foam layer 9 is then compressed in volume in proportion to supported weight of the user and thereby automatically adjusts the effective seating volume. In this manner, the effective seating volume for the lighter user A is automatically, self-adjusted to be smaller than the effective seating well volume for the heavier user F who will compress the foam layer 9 more.

Further Embodiments of FIGS. 20–23

In the further embodiment of FIGS. 20 and 21, the foam layer includes band portions or legs 9' similar to those of FIGS. 1–3. As shown, the legs 9' are spaced from each other across the upper surface 19 to form a first gap and are also separated by a second gap at 41 at the base of the U-shaped upper surface 19'. This second gap 41 allows for the comfort of the user or the addition of an abductor if desired. Additionally, the foam layer legs 9' are individually enclosed in envelopes 43 of waterproof, airtight material and are provided with rear exiting vent means 45. Vent means 45 allow the air from the open-celled foam to vent through the envelopes 43 to atmosphere rearwardly of the fluid pad 7 (which would be positioned in use over the seating well 17 and foam layer legs 9' in FIG. 20). This venting would occur as in the other embodiments when the foam legs 9' are compressed under the weight of the user on the fluid pad 7 and foam legs 9'.

The additional embodiment of FIGS. 22 and 23 shows the enveloped foam legs 9' of FIG. 20 positioned within the fluid of the fluid pad 7. Vent means 45 as in FIG. 20 then serve to vent air to atmosphere rearwardly of the fluid pad 7 as the foam legs 9' are compressed under the user's weight.

While several embodiments of the present invention have been shown and described in detail, it is to be understood that various changes and modifications could be made without departing from the scope of the invention.

We claim:

1. A self-adjusting seating system including:

a relatively rigid, shaped tray having forward and rearward sections adjacent one another, said forward section having an upper surface forming a shelf to support a user's thighs and said rearward section having a depressed, contoured seating well with an upper surface intended to support the user's buttocks including the user's ischial tuberosities, said seating well having a first volume, a fluid pad with at least a section containing a substantially fixed volume of substantially incompressible fluid, said incompressible fluid having a second volume less than said first volume of said seating well, and means for positioning said fluid pad section substantially within said first volume of said seating well, and means for occupying varying amounts of said first volume substantially in proportion to the weight of the user supported by said upper surface of said seating well, said varying means occupying less of the first volume as said supported weight increases, said varying means including a layer of resilient, compressible material, and means for positioning said varying means substantially between at least a portion of said fluid pad section and a portion of the upper surface of said seating well.

2. The self-adjusting seating system of claim 1 wherein said resilient, compressible material has open cells and vents air from said open cells as said material is compressed under the weight of the user.

3. The self-adjusting seating system of claim 2 wherein said seating well has a bottom portion and a rim portion extending substantially about and upwardly from said bottom portion, each of said bottom and rim portions having an upper surface together forming at least a part of the upper surface of said seating well, said means for positioning said layer of resilient, compressible material including means for positioning said layer of resilient, compressible material substantially between at least a portion of said fluid pad section and the upper surface of said rim portion of said seating well.

4. The self-adjusting seating system of claim 3 wherein said layer of resilient, compressible material includes a band portion substantially corresponding to the rim portion and said layer positioning means positions said band portion substantially between at least a portion of said fluid pad section and the upper surface of said rim portion of said seating well.

5. The self-adjusting seating system of claim 3 wherein said rim portion is substantially U-shaped and said layer of resilient, compressible material at least includes portions corresponding to the legs of said U-shape.

6. The self-adjusting seating system of claim 5 wherein said legs of said layer of resilient, compressible material are spaced from each other about said rim portion leaving a gap in the layer about said rim portion substantially at the base of the U-shape of said rim portion.

7. The self-adjusting seating system of claim 5 wherein said legs of said layer of resilient, compressible material are spaced from each other across said bottom portion of said seating well leaving a gap in the layer extending substantially across said bottom portion of said seating well.

8. The self-adjusting seating system of claim 7 wherein said gap extends substantially across and substantially completely over the bottom portion of said seating well.

9. The self-adjusting seating system of claim 3 wherein said layer positioning means substantially positions said layer of resilient, compressible material away from the bottom portion of said seating well and said positioning means for said fluid pad section positions at least a portion of said fluid pad section over the upper surface of said bottom portion of said seating well.

10. The self-adjusting seating system of claim 2 further including substantially waterproof, airtight means for substantially enclosing said layer of resilient, compressible material, said enclosing means having vent means for venting said air from said open cells out of said enclosing means as said material is compressed under the weight of the user.

11. The self-adjusting seating system of claim 10 wherein said enclosing means includes an envelope of substantially waterproof, airtight material and said vent means includes at least one hole extending through said waterproof, airtight envelope.

12. The self-adjusting seating system of claim 1 wherein said seating well has a perimeter enclosing a first area and said fluid pad section has a perimeter enclosing a second area, said second area being substantially larger than said first area wherein said fluid pad section is oversized relative to said seating well, and means for positioning the perimeter of said fluid pad section substantially over the perimeter of said seating well.

13. The self-adjusting seating system of claim 1 wherein said fluid pad section has at least two subsections, each subsection including at least one pouch substantially filled with incompressible fluid.

14. The self-adjusting system of claim 1 wherein said layer of resilient, compressible material includes open-celled foam.

15. The self-adjusting seating system of claim 1 wherein said incompressible fluid is a highly viscous liquid.

16. The self-adjusting seating system of claim 1 wherein said fluid pad is oversized relative to said seating well to substantially prevent hammocking of the fluid pad in use.

17. A self-adjusting seating system including:

a relatively rigid, shaped tray having forward and rearward sections adjacent one another, said forward section having an upper surface forming a shelf to support a user's thighs and said rearward section having a depressed, contoured seating well with an upper surface intended to support the user's buttocks including the user's ischial tuberosities, said seating well having a first volume, a fluid pad with at least a section containing a substantially fixed volume of substantially incompressible fluid, said incompressible fluid having a second volume less than said first volume of said seating well, and means for positioning said fluid pad section substantially within said first volume of said seating well, and means positioned between said fluid pad section and the upper surface of said seating well, said means occupying a portion of said first volume of said seating well creating an effective seating well volume of the first volume less the volume of said means, said means including means for automatically adjusting the effective seating well volume substantially in proportion to the weight of the user supported by the upper surface of said seating well, said adjusting means including a layer of resilient compressible material, said effective seating well volume increasing as said supported weight increases.

18. The self-adjusting seating system of claim 17 wherein said resilient, compressible material has open cells and vents air from said open cells as said material is compressed under the weight of the user.

19. The self-adjusting seating system of claim 18 further including substantially waterproof, airtight means for substantially enclosing said layer of resilient, compressible material, said enclosing means having vent means for venting said air from said open cells out of said enclosing means as said material is compressed under the weight of the user.

20. The self-adjusting seating system of claim 19 wherein said enclosing means includes an envelope of substantially waterproof, airtight material and said vent means includes at least one hole extending through said waterproof, airtight envelope.

21. The self-adjusting seating system of claim 19 wherein said seating well has a perimeter enclosing a first area and said fluid pad section has a perimeter enclosing a second area, said second area being substantially larger than said first area wherein said fluid pad section is oversized relative to said seating well, and means for positioning the perimeter of said fluid pad section substantially over the perimeter of said seating well.

22. The self-adjusting seating system of claim 21 wherein said fluid pad section has at least two subsections, each subsection including at least one pouch substantially filled with incompressible fluid.

23. The self-adjusting seating system of claim 17 wherein said layer of resilient, compressible material includes open-celled foam.

24. The self-adjusting seating system of claim 17 wherein said incompressible fluid is a highly viscous liquid.

25. The self-adjusting seating system of claim 17 wherein said fluid pad is oversized relative to said seating well to substantially prevent hammocking of the fluid pad in use.

26. A seating system including:

a relatively rigid, shaped tray having forward and rearward sections adjacent one another, said forward section having an upper surface forming a shelf to support a user's thighs and said rearward section having a depressed, contoured seating well with an upper surface intended to support the user's buttocks including the user's ischial tuberosities, a fluid pad with at least a section containing a substantially fixed volume of substantially incompressible fluid, said section having means for enclosing said fluid including a substantially waterproof, airtight envelope substantially surrounding said fluid, and means for positioning said fluid pad section over at least a portion of the upper surface of said seating well, a layer of resilient, compressible material and means for positioning said layer between at least a portion of said fluid pad section and said portion of the upper surface of said seating well, said resilient, compressible material having open cells and venting air when compressed under the weight of the user, and said seating system further including substantially waterproof, airtight means substantially enclosing said layer of resilient, compressible material, said layer enclosing means having vent means for venting air from said open cells out of said layer enclosing means as said layer of material is compressed under the weight of the user.

27. The seating system of claim 26 wherein said layer enclosing means includes an envelope of substantially waterproof, airtight material surrounding said layer and said vent means includes at least one hole extending through said envelope.

28. The seating system of claim 27 wherein said fluid pad section has a perimeter and said one hole is positioned outwardly of said perimeter.

29. The seating system of claim 27 wherein said envelope has upper and lower members and means for securing said members together to form a sealed perimeter substantially enclosing said layer, one of said envelope members being completely waterproof and airtight and the other envelope member having said vent hole therethrough.

30. The seating system of claim 29 wherein said other envelope member is the upper envelope member.

31. The seating system of claim 26 wherein said fluid pad section has a perimeter and said vent means is positioned outwardly of said perimeter.

32. The seating system of claim 26 wherein said seating well has a perimeter and said vent means is positioned adjacent said perimeter.

33. The seating system of claim 32 wherein said vent means is positioned outwardly of said seating well.

34. The seating system of claim 26 further including means for securing said layer and said fluid pad section together to form a one-piece unit.

35. The seating system of claim 34 wherein said securing means includes means for securing the enclosing means of said fluid pad section to the enclosing means of said layer.

36. The seating system of claim 34 wherein said securing means is a heat seal.

37. The seating system of claim 26 further including means for positioning said fluid pad section substantially within said seating well.

38. The seating system of claim 26 wherein said seating well has a perimeter enclosing a first area and said fluid pad section has a perimeter enclosing a second area, said second area being substantially larger than said first area wherein said fluid pad section is oversized relative to said seating well, and means for positioning the perimeter of said fluid pad section substantially over the perimeter of said seating well.

39. The seating system of claim 38 wherein said fluid pad section has at least two subsections, each subsection including at least one pouch substantially filled with incompressible fluid.

40. The seating system of claim 26 wherein said fluid pad section substantially surrounds and encloses said layer.

41. The seating system of claim 40 wherein said vent means vents said air out of said layer enclosing means to atmosphere.

42. The seating system of claim 26 wherein said resilient, compressible material includes a layer of open-celled, resilient, compressible foam.

43. The seating system of claim 26 wherein said incompressible fluid is a highly viscous liquid.

44. The seating system of claim 26 wherein said fluid pad is oversized relative to said seating well to substantially prevent hammocking of the fluid pad in use.

45. A seating system including:

a relatively rigid, shaped tray having forward and rearward sections adjacent one another, said forward section having an upper surface forming a shelf to support a user's thighs and said rearward section having a depressed, contoured seating well with an upper surface intended to support the user's buttocks including the user's ischial tuberosities, said seating well having a bottom portion and a rim portion extending substantially about and upwardly from said bottom and rim portions having an upper surface together forming at least a part of the upper surface of said seating well, a fluid pad with at least a section containing a substantially fixed volume of substantially incompressible fluid, said section having means for enclosing said fluid including a substantially waterproof, airtight envelope substantially surrounding said fluid, and means for positioning at least portions of said fluid pad section over portions of said upper surfaces of said bottom and rim portions of said seating well, and a layer of resilient, compressible material and means for positioning said layer between at least a portion of said fluid pad section and the upper surface of said rim portion of said seating well, said layer positioning means positioning said layer away from the upper surface of the bottom portion of said seating well.

46. The seating system of claim 45 wherein said layer of resilient, compressible material includes a band portion substantially corresponding to the upper surface of said rim portion.

47. The seating system of claim 45 wherein said rim portion is substantially U-shaped and said layer of resilient, compressible material at least includes portions corresponding to the legs of said U-shape.

48. The seating system of claim 47 wherein said legs of said layer of resilient, compressible material are spaced from each other about said rim portion leaving a gap in the layer about said rim portion substantially at the base of the U-shape of said rim portion.

49. The seating system of claim 47 wherein said legs of said layer of resilient, compressible material are spaced from each other across said bottom portion of said seating well leaving a gap in the layer extending substantially across said bottom portion of said seating well.

50. The seating system of claim 49 wherein said gap extends substantially across and substantially completely over the bottom portion of said seating well.

51. The seating system of claim 45 further including substantially waterproof, airtight means for substantially enclosing said layer of resilient, compressible material, said enclosing means having vent means for venting said air from said open cells out of said enclosing means as said layer of material is compressed under the weight of the user.

52. The seating system of claim 51 wherein said enclosing means includes an envelope of substantially waterproof, airtight material and said vent means includes at least one hole extending through said waterproof, airtight envelope.

53. The seating system of claim 45 wherein said seating well has a perimeter enclosing a first area and said fluid pad section has a perimeter enclosing a second area, said second area being substantially larger than said first area wherein said fluid pad section is oversized relative to said seating well, and means for positioning the perimeter of said fluid pad section substantially over the perimeter of said seating well.

54. The seating system of claim 53 wherein said fluid pad section has at least two subsections, each subsection including at least one pouch substantially filled with incompressible fluid.

55. The seating system of claim 45 wherein said layer of material includes a layer of open-celled, resilient, compressible foam.

56. The seating system of claim 45 wherein said incompressible fluid is a highly viscous liquid.

57. The seating system of claim 45 wherein said fluid pad is oversized relative to said seating well to substantially prevent hammocking of the fluid pad in use.

* * * * *